US005806576A

United States Patent [19]

Sutherlin

[11] Patent Number: 5,806,576

[45] Date of Patent: Sep. 15, 1998

[54] SAND BAG FILLING MACHINE

[76] Inventor: Dave Sutherlin, 30 S. Tuxedo St., Indianapolis, Ind. 46201

[21] Appl. No.: 897,330

[22] Filed: Jul. 21, 1997

[51] Int. Cl.[6] ..... B65B 1/04

[52] U.S. Cl. ..... 141/314; 141/10; 141/114; 141/234

[58] Field of Search ..... 141/10, 114, 313–317, 141/234, 247, 248, 166, 178, 179

[56] References Cited

U.S. PATENT DOCUMENTS

| | | | |
|---|---|---|---|
| 441,302 | 11/1990 | Harmless | 141/248 |
| 862,231 | 8/1907 | Bates | 141/317 |
| 1,244,900 | 10/1917 | Runions | 141/317 |
| 2,852,045 | 9/1958 | Goodner . | |
| 3,552,346 | 1/1971 | Garden . | |
| 3,587,674 | 6/1971 | Adkin . | |
| 4,020,881 | 5/1977 | Nothen . | |
| 4,106,535 | 8/1978 | Davis . | |
| 4,192,359 | 3/1980 | Pippin . | |
| 4,241,769 | 12/1980 | Wiesner . | |
| 5,215,127 | 6/1993 | Bergeron . | |
| 5,353,850 | 10/1994 | Ueda et al. . | |

*Primary Examiner*—J. Casimer Jacyna
*Assistant Examiner*—Steven O. Douglas
*Attorney, Agent, or Firm*—Michael B. McNeil

[57] ABSTRACT

Presented herein is a sand bag filling machine having a hopper mounted to a frame. An upper table is moveably mounted beneath the hopper. The upper table has a plurality of holes that align with a bottom opening on the hopper as the table moves from a first position to a second position. When the table is in either the first position or the second position, the table blocks the flow of sand from the hopper. Below the upper table is a holding apparatus for suspending the bags from the upper table while allowing sand to flow from the hopper and into the bags. In one embodiment, a lower table catches the filled sand bags. The lower table can be pivotable about an axis facilitating removal of the sand bags. A method of use is also presented.

20 Claims, 5 Drawing Sheets

SAND BAG FILLING MACHINE

BACKGROUND OF THE INVENTION

The invention relates to a machine or an apparatus for filling sand bags with sand.

In building close to waterways, lakes and rivers it has always been desirable to prevent damage to property during flooding periods. One such method of holding back flood water is the use of sand bags. Generally, sand bags are filled by hand using a group of volunteer laborers. Sand bags are also used in military settings to create a temporary wall.

It is known in U.S. Pat. No. 5,215,127 to fill sand bags using the device of the '127 patent to fill one bag at a time with a multitude of openings. A laborer holds a bag while the sand is directed to the tube for filling the bag at his station. This method requires each bag to be filled individually while the remaining stations wait.

Nothen, U.S. Pat. No. 4,020,881 shows a horizontally moving conveyor underneath a hopper that fills one row of containers at each time with dirt.

Wiesner, U.S. Pat. No. 4,241,769, discloses supporting bags being filled by holding the bag at its open end with a collar device.

Goodner, U.S. Pat. No. 2,852,045, discloses a pneumatically operated bag holder that appears to use diaphragms to pinch the rim of a bag in place.

Garden, U.S. Pat. No. 3,552,346, discloses a device for mounting to a dump truck that allows for filling of sand bags while supporting the bags by hand and a platform.

What is needed is an apparatus for rapidly filling sand bags, wherein the bags are held in place and the sand moves from a hopper into the bags with minimal manual labor. The bags can then be released from the apparatus and placed into use.

SUMMARY OF THE INVENTION

A sand bag filling machine has a hopper that is attached to a frame. The hopper has a bottom opening. An upper table has a plurality of holes passing through the table between a first end of the table and a second end. The table is moveably supported by the frame and travels underneath the bottom opening of the hopper between a first position and a second position. The table includes at least one holding apparatus that is moveable between a hold position and a release position. A plurality of sand bags are releasably suspended from the upper table underneath different ones of the plurality of holes by the holding apparatus.

In another embodiment, the table moves from a first position to a second position along a line. A linear drive mechanism is attached on one end to the table and on the other end to the frame for moving the table from the first position to the second position. The table operates to close the bottom opening when in the first position and in the second position.

In still another embodiment, an air cylinder is part of the linear drive mechanism and is sized for moving the table from the first position to the second position. A plurality of removable collars are supported by the upper table and are positioned in different ones of the plurality of holes. The plurality of sand bags are pinched between one of the holding apparatuses and one of the removable collars when the holding apparatuses are in the hold position. A lower table is pivotally attached to the frame and is pivotable from a substantially horizontal position to a pivoted position.

DESCRIPTION OF THE PREFERRED EMBODIMENT

Figure 1:
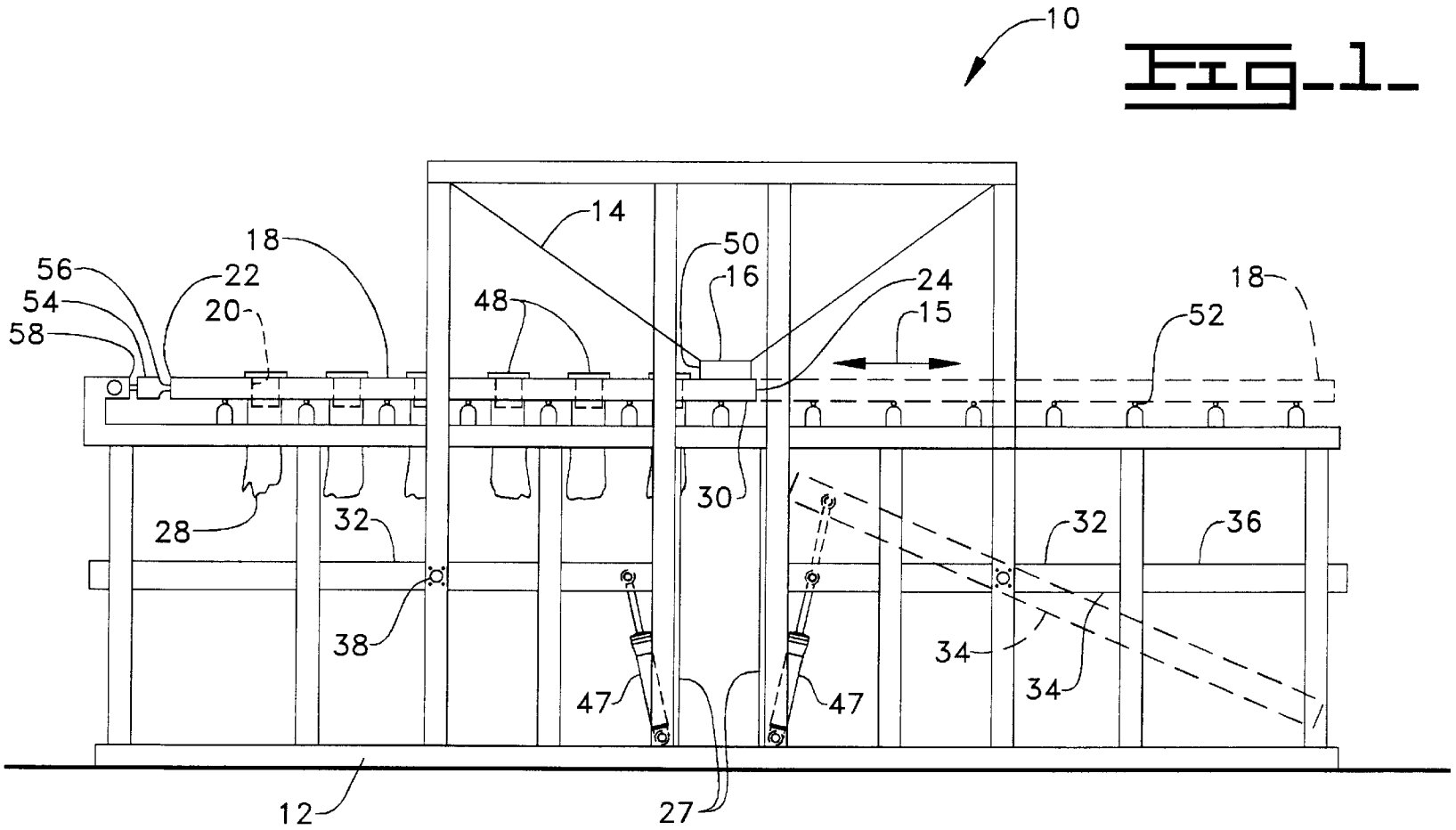
FIG. 1 is a front elevational view of the apparatus according to one embodiment of the invention.

Referring now to FIG. 1, the sand bag filling machine generally indicated as 10 has a steel frame 12 with an attached steel hopper 14. The hopper 14 is a large gravity fed container for holding sand. The hopper 14 preferably has a four-sided inverted cone shape made from welded sheet metal or steel plate, and preferably has a width sized to accommodate the bucket of a front loader. The hopper 14 has a bottom opening 16 in communication with an upper table 18. The upper table 18 has a plurality of holes 20, preferably in a series of rows, located between a first end 22 and a second end 24. The upper table 18 is supported by the frame 12 and is preferably made from a piece of rectangular steel plate of an appropriate thickness.

The upper table 18 is movable along a horizontal line 15 from a first position to a second position, as shown, along a set of rollers 52. When the upper table 18 is in its first position, the first end 22 of the table 18 operates to block the bottom opening 16. As the table 18 passes from the first position to the second position, the plurality of holes 20 line up sequentially with the bottom opening 16 of the hopper 14, allowing sand to flow from the hopper 14 into the holes 20. When the table 18 reaches the second position, the second end 24 blocks the bottom opening 16 of the hopper. The bottom opening 16 of the hopper 14 is preferably positioned approximately one inch from the upper table 18. A flexible skirt 50, preferably made from a rubber material, is mounted around the bottom opening 16 sealing the hopper 14. Skirt 50 sweeps upper table 18 clear of sand when the table moves. A set of channels 27 are preferably welded to the frame 12 and operable to guide excess sand to the side of the machine 10 to be reused.

Figure 2:
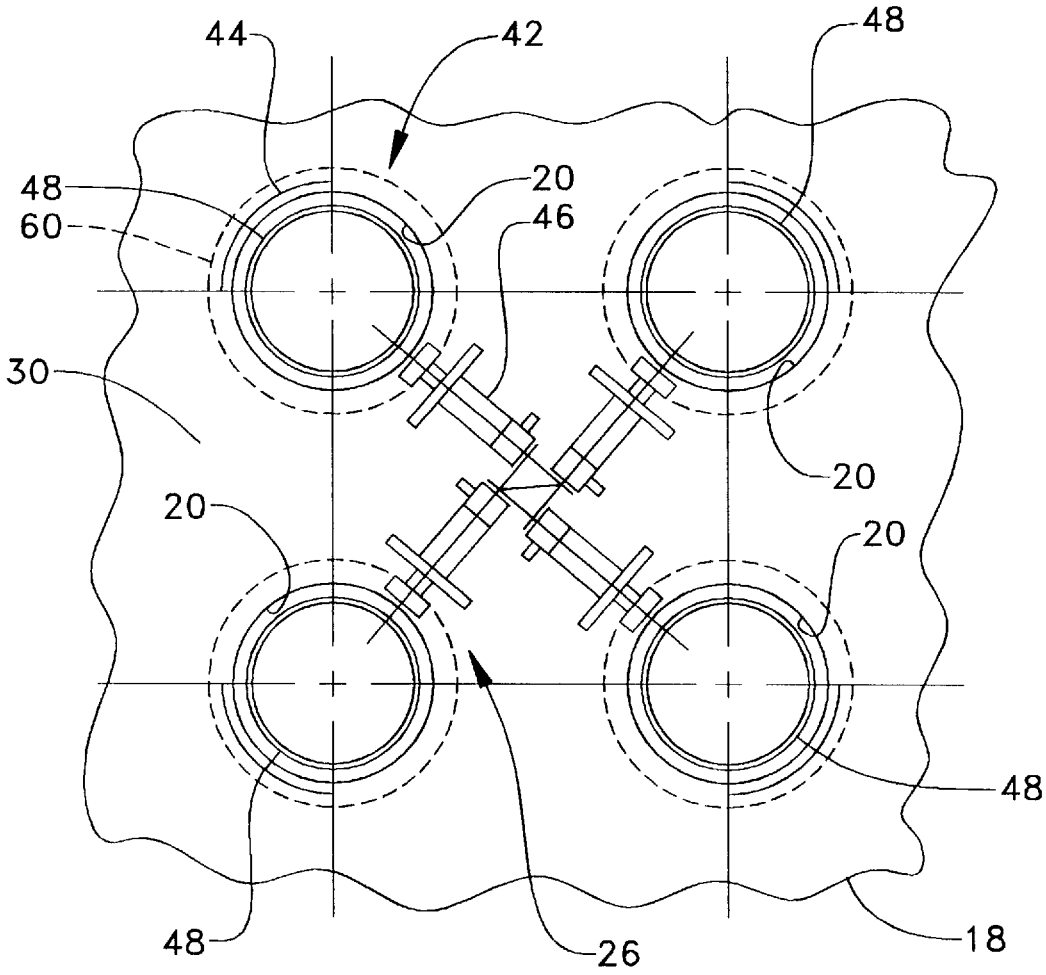
FIG. 2 is a partial bottom view of the underside of the upper table showing of the holding apparatus according to one aspect of the invention.
Figure 3:
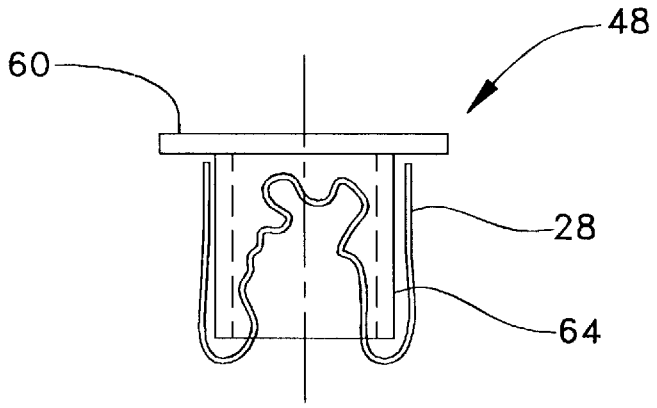
FIG. 3 is a front elevational view of a removable collar according to another aspect of the invention.
Figure 4:
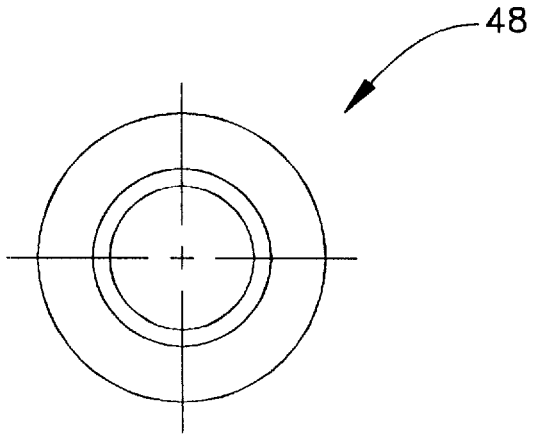
FIG. 4 is a bottom view of a removable collar according to an aspect of the invention.

Referring now to FIG. 2, adjacent each of the plurality of holes 20 is a holding apparatus 26 mounted to the underside 30 of table 18 that is capable of holding a filled sand bag 28. The underside 30 of upper table 18 is positioned such that a filled sandbag 28 is within about one foot of a surface 32 located on a lower table 34. The surface 32 is a top side 36 of lower table 34. Because the sand bags 28 are not tied before dropping them from the upper table 18, the one foot distance is a height at which the filled bags 28 may drop without falling over and spilling the sand. The bags are preferably tied manually after dropping to the lower table. The lower table 34 is attached to the frame 12 and is pivotable about an axis with respect to the frame 12. By pivoting the lower table 34, the sandbags 28 are more easily removed.

In one embodiment the lower table 34 has an air cylinder 47 to power the lower table into its pivoted position (as shown in shadow) to dump the filled and tied sand bags 28 off of the lower table 34 to the side. The lower table 34 may also contain a short wall to help keep the bags 28 in the standing position when in its horizontal position. On one end of the table 34, the wall could be openable similar to a tail gate of a truck.

Figure 5:
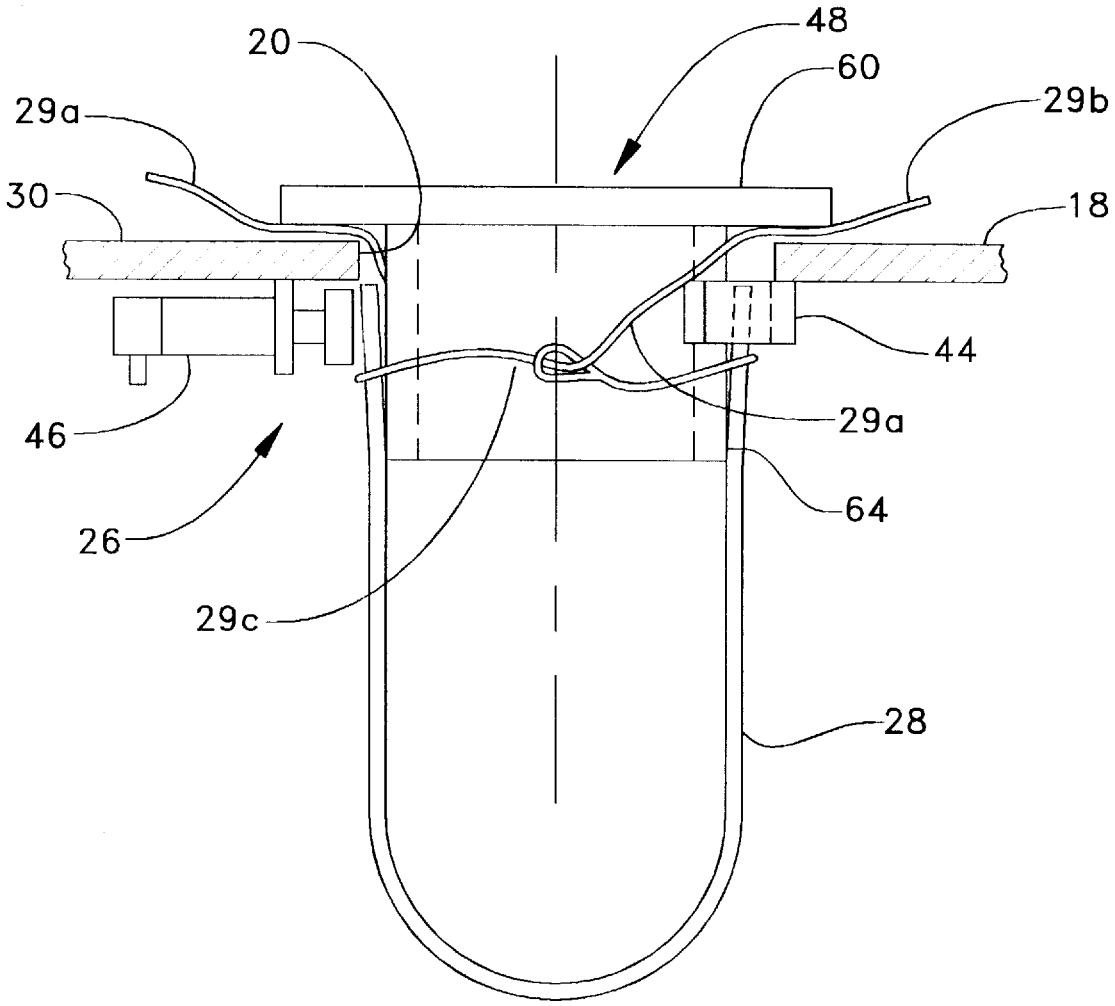
FIG. 5 is a cut-away view of a filled sand bag with a removable collar suspended from the upper table according to one aspect of the invention.

An alternative design of sand bag 28, is to have a sandbag with two drawstrings 29*a* and 29*b* having loops 29*c*, only one of which is visible in FIG. 5. The first loop is passed through the second loop and the loose ends extend above upper table 18 and are pinched under flange 60. When the sand bag 28 is released from the holding apparatus 26, the weight of the sand pulls the drawstrings tight. Teeth on the drawstrings catch in the loops to maintain the bags automatically tied when pulled tight. The loose ends fixed to the upper table 18 are broken by the weight of the sand. The ends of the drawstrings are broken by having a weakened section or by creating a notch in the material to create a weak area.

The standard sand bag 28 has an 8 inch opening and is approximately 18 inches long. A removable collar 48 has a flange 60 that is larger in dimension than the diameter of the plurality of holes 20. The collar 48 also has a tubular section 64 that extends down from the flange 60. In a preferred embodiment, the plurality of holes 20 are 7 inches in diameter and the flange 60 is 8.5 inches in diameter. The tubular section 64 is 6 inches in diameter and 4 inches long. The particular dimensions of the collar 48 are such that the bags 28 can be slid over the tubular section 64 and the remaining portion of the bag stuffed inside the tube. This arrangement allows easy handling of the bag/collar assembly without the bag 28 falling off of the removable collar 48. This permits numerous bag/collar assemblies to be prepared before operation of machine 10 in order to further hasten the filling of sand bags when the device is put into operation. The collar 48 may be made from PVC or other suitable material.

One sand bag 28/removable collar 48 assembly is placed into each one of the plurality of holes 20 in the upper table 18. The holding apparatus 26 in one embodiment is a pneumatically operated clamp 42. The clamp 42 consists of an opposition member 44 and an air cylinder 46 mounted on the underside 30 of the upper table 18. After a set of bag/collar assemblies have been placed in the plurality of holes 20, the pneumatically operated clamp 42 is activated to hold the sand bags 28 in place. When activated, the air cylinder 46 presses the tubular section 64 against the opposition member 44, pinching sand bag 28 there between. This suspends the sand bags 28 from the upper table 18. The opposition member 44 is generally a concave piece of metal welded to the underside 30 of the upper table 18.

A linear drive mechanism 54 is operable to move the upper table 18 back and forth between a first position to a second position. The upper table 18 moves in a line 15 along a set of rollers 52 mounted to the frame 12. The table 18 can be driven by a reduction gear motor, hydraulics or by an air cylinder 58. One advantage of using compressed air to drive the upper table 18, the clamps and the tilting lower table 34 is that no other source of energy is required to operate the machine 10. The machine 10 could utilize a set of quick connect valves to hook up the various air cylinders to a compressed air source, such as a gas powered air compressor at a sand bag filling site.

Figure 6:
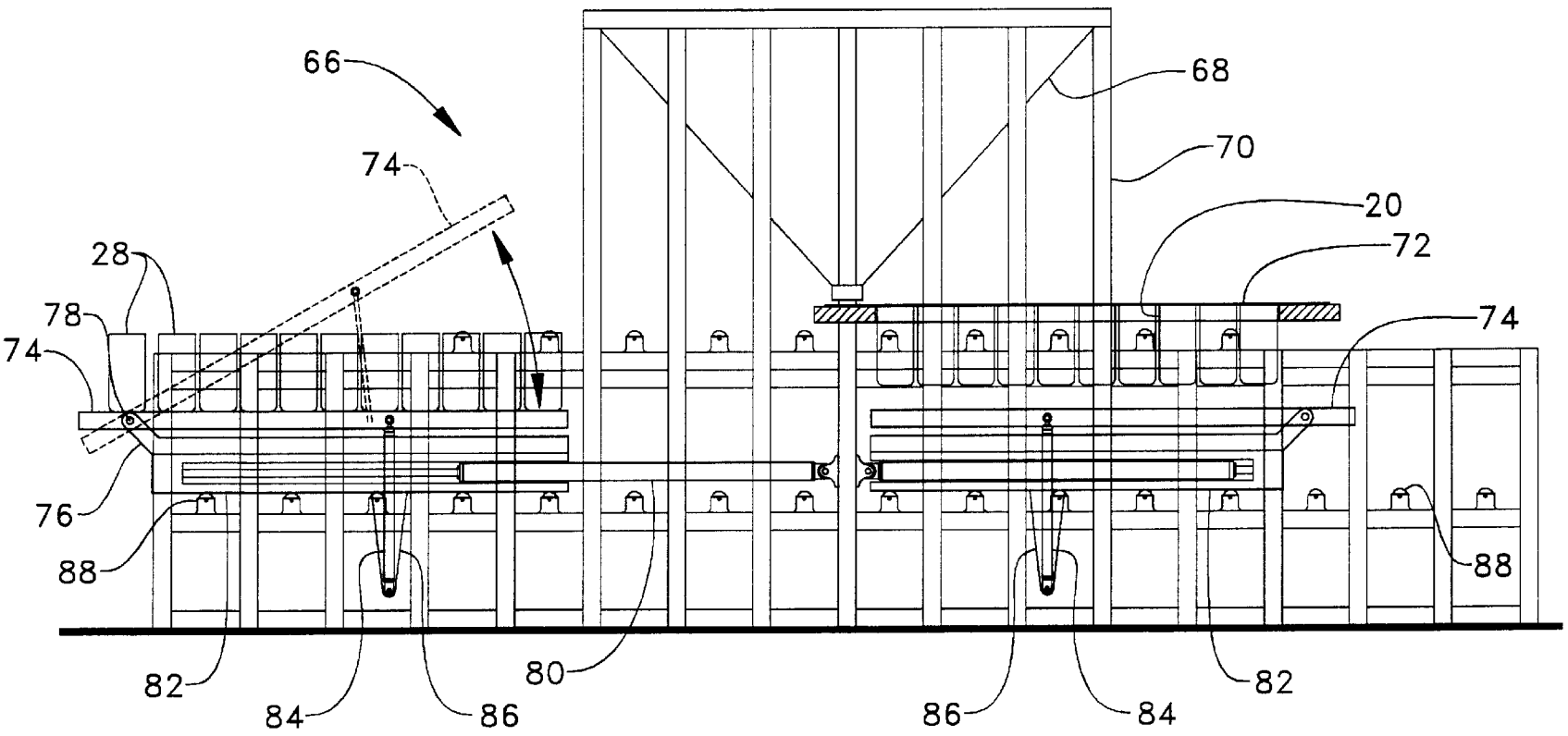
FIG. 6 is a front view of an alternative embodiment of the invention.

Referring now to FIG. 6, an alternative sand bag filling machine 66 is shown. A hopper 68 is mounted to the top of frame 70. An upper table 72 is present with a plurality of holes 20 as was described in an earlier embodiment. The holding apparatus 26 is the same as described previously, also. A pair of lower tables 74 are mounted to a bracket 76 and are operable to translate horizontally relative to the frame 70. The bracket 76 is connected to the lower table 74 by a bearing 78 that is operable to allow the table to pivot from a generally horizontal position to a tilted position. The left end of the drawing shows one of the lower tables 74 in an extended position and in phantom shows the table 74 tilted, allowing easy removal of the filled sand bags 28 from the lower table 74. The lower table 74 translates by an air cylinder 80 housed in a tube 82 and mounted to the bracket 76 on one end and the frame 70 on the other end. The tube 82 operates to prevent sand from getting into the air cylinder 80. The tube 82 is attached to the bracket 76 and both the tube 82 and the bracket 76 travel with the lower table 74. A series of rollers 88 support the tube 82 and allow the table 74 to translate. A second air cylinder 84 is mounted to the lower table 74 and to the tube 82 by an extension 86. When the lower table 74 is in the extended position, the second air cylinder 84 is activated to tilt the lower table 74 from a generally horizontal position to facilitate removal of the filled sand bags 28 after the same have been tied. The right side of FIG. 6 shows one of the lower tables 74 in a retracted position. While in the retracted position, the table 74 operates to catch the filled sand bags 28.

As previously described, the upper table 72 travels between a first position and a second position while filling the sand bags 28 with sand. The lower table 74 is tilted when the upper table 72 is in the opposite position. For example, when the upper table 72 is to the far right position, the lower table 74 is moved to the far left to facilitate tying the bags, and then tilted to remove the filled bags for use.

Referring back to FIG. 1, in one method of use, the machine 10 has a frame 12, a hopper 14 having a bottom opening 16 and an upper table 18. The upper table 18 has a plurality of holes 20 sized to receive a sand bag 28. The sand bags 28 are assembled to a removable collar 48 prior to insertion in the plurality of holes 20. The holding apparatus 26 is activated, suspending the sand bags 28 from the upper table 18. A quantity of sand is placed into the hopper 14. The upper table 18 then begins moving from a first position toward a second position, allowing the sand bags 28 to be filled with sand as the table moves under hopper 14. After reaching the second position, the holding apparatus 26 is released allowing the filled sand bags 28 to drop to the ground, or the lower table 34, if present. The empty collars 48 are then removed and, another set of sand bag/collar assemblies are placed in the plurality of holes 20, and if necessary more sand is added to the hopper 14. The upper table 18 then passes from the second position back to the first position. While the table is on an opposite side, personnel move in to tie the dropped bags. The release step is repeated. The machine 10 can also be mounted on a trailer, and pulled by a truck. After each cycle, the truck would pull forward, leaving the bags behind on the ground for personnel to tie the same.

In a stationary version having a lower table, the bags would drop to the lower table 34. After tying the bags, the table 34 is then pivoted to slide the bags 28 clear of the machine 10. In such a case, machine 10 might be mounted on a rail car.

The machine 10 can also be placed on the upper portion of a highway overpass. The sand, loader, bags 28 and collars 48 are located with the machine 10. A dump truck or other source of transport is located below. After the bags are filled and tied, the lower table pivots up so that the bags slide over the edge of the overpass and fall into the awaiting truck to be hauled away. It has been discovered that a tied sand bag 28 may be dropped from a height of about 18 feet without breaking open.

While the invention has been described in specific terms the specification is in no way intended to limit the scope and spirit of the invention as defined by the claims set forth below.

I claim:

1. A sand bag filling machine comprising:

a frame;

a hopper with a bottom opening attached to said frame;

an upper table defining a plurality of holes there through, and said upper table being movably supported by said frame underneath said bottom opening of said hopper, and said upper table being movable between a first position and a second position with respect to said hopper;

at least one holding apparatus attached to said upper table and being movable between a hold position and a release position; and a plurality of sand bags, each being releasably suspended from said upper table underneath a different one of said plurality of holes by said holding apparatus.

2. The sand bag filling machine of claim 1 further comprising a surface positioned less than about a foot below a bottom of a filled sand bag that is being held by said holding apparatus.

3. The sand bag filling machine of claim 2 wherein said surface is a top side of a lower table attached to said frame underneath said upper table.

4. The sand bag filling machine of claim 3 wherein said lower table is attached to said frame and pivotable with respect to said frame about an axis.

5. The sand bag filling machine of claim 4 wherein said upper table is movable between said first position and said second position along a line; and said line and said axis are substantially horizontal.

6. The sand bag filling machine of claim 5 wherein said line is substantially perpendicular to said axis.

7. The sand bag filling machine of claim 1 wherein said at least one holding apparatus is a plurality of pneumatically actuated clamps.

8. The sand bag filling machine of claim 7 wherein each of said pneumatically actuated clamps includes a fixed opposition member attached to said upper table and an air cylinder attached to said upper table.

9. The sand bag filling machine of claim 8 further comprising a plurality of removable collars supported by said upper table and each being positioned in a different one of said plurality of holes; and each of said plurality of sand bags is pinched between said fixed opposition member and said removable collar and pinched between said air cylinder and said removable collar when said at least one holding apparatus is in said hold position.

10. The sand bag filling machine of claim 1 further comprising a flexible skirt attached to said hopper around said bottom opening; and said flexible skirt is positioned in contact with said upper table.

11. The sand bag filling machine of claim 1 wherein said upper table closes said bottom opening of said hopper when in said first position and when in said second position; and different ones of said plurality of holes being sequentially open to said bottom opening of said hopper when said upper table is moved from said first position to said second position.

12. The sand bag filling machine of claim 1 wherein said upper table is supported by a plurality of rollers attached to said frame; and said upper table is movable along a line on said plurality of rollers between said first position and said second position.

13. The sand bag filling machine of claim 12 further comprising a lower table pivotally attached to said frame and being pivotable about an axis; and said axis and said line are substantially horizontal but substantially perpendicular to each other.

14. The sand bag filling machine of claim 12 further comprising a linear drive mechanism with one end attached to said frame and an other end attached to said upper table; and said linear drive mechanism being sized to move said upper table between said first position and said second position.

15. The sand bag filling machine of claim 14 wherein said linear drive mechanism includes at least one air cylinder.

16. A sand bag filling machine comprising:

a frame;

a hopper with a bottom opening attached to said frame;

an upper table defining a plurality of holes there through that are located between a first end and a second end, and said upper table being movably supported by said frame underneath said bottom opening of said hopper, and said upper table being movable back and forth along a line between a first position and a second position with respect to said hopper;

a plurality of holding apparatuses attached to said upper table and being movable between a hold position and a release position;

a plurality of sand bags, each being releasably suspended from said upper table underneath a different one of said plurality of holes by one of said holding apparatuses a linear drive mechanism with one end attached to said frame and an other end attached to said upper table, and being sized to move said upper table between said first position and said second position; and said upper table closes said bottom opening of said hopper when in said first position and when in said second position.

17. The sand bag filling machine of claim 16 wherein each of said holding apparatuses includes an air cylinder.

18. The sand bag filling machine of claim 17 further comprising a plurality of removable collars supported by said upper table and each being positioned in a different one of said plurality of holes; and each of said plurality of sand bags is pinched between one of said holding apparatuses and one of said removable collars when in said hold position.

19. The sand bag filling machine of claim 16 further comprising a lower table pivotably attached to said frame underneath said upper table, and being pivotable from a substantially horizontal position to a pivoted position.

20. A sand bag filling machine comprising:

a frame;

a hopper with a bottom opening attached to said frame;

an upper table defining a plurality of holes there through that are located between a first end and a second end, and said upper table being movably supported by said frame underneath said bottom opening of said hopper, and said upper table being movable back and forth along a line between a first position and a second position with respect to said hopper;

a plurality of holding apparatuses attached to said upper table and being moveable between a hold position and a release position, and each of said holding apparatuses includes an air cylinder;

a plurality of sand bags, each being releasably suspended from said upper table underneath a different one of said plurality of holes by one of said holding apparatuses a linear drive mechanism that includes an air cylinder with one end attached to said frame and an other end attached to said upper table, and being sized to move said upper table between said first position and said second position;

said upper table closes said bottom opening of said hopper when in said first position and when in said second position;

a plurality of removable collars supported by said upper table and each being positioned in a different one of said plurality of holes;

each of said plurality of sand bags being pinched between one of said holding apparatuses and one of said removable collars when in said hold position; and a lower table pivotably attached to said frame less than about a foot underneath said upper table, and being pivotable from a substantially horizontal position to a pivoted position.

* * * * *